US007275744B1

(12) United States Patent
Kuo

(10) Patent No.: US 7,275,744 B1
(45) Date of Patent: Oct. 2, 2007

(54) PUZZLE PEN

(76) Inventor: Chin-Yi Kuo, No. 29, Lane 14, Hoping Rd., Panchiao, Taipei Hsien (TW)

( * ) Notice: Subject to any disclaimer, the term of this patent is extended or adjusted under 35 U.S.C. 154(b) by 0 days.

(21) Appl. No.: 11/424,978

(22) Filed: Jun. 19, 2006

(51) Int. Cl.
*A63F 9/08* (2006.01)

(52) U.S. Cl. ..... 273/153 S

(58) Field of Classification Search ..... 273/153 S, 273/153 R, 157 R, 156
See application file for complete search history.

(56) References Cited

U.S. PATENT DOCUMENTS 4,949,969 A * 8/1990 Johnson ..... 273/153 S
4,983,062 A * 1/1991 Hour ..... 401/195
5,074,561 A * 12/1991 Johnson ..... 273/153 S
5,083,788 A * 1/1992 Conotter ..... 273/153 S
5,116,053 A * 5/1992 Blankenburg et al. ... 273/153 S
5,429,364 A * 7/1995 Chang ..... 273/153 S
5,845,904 A * 12/1998 Hawkins ..... 273/153 S
6,739,780 B1 * 5/2004 Kuo ..... 401/195
6,966,717 B1 * 11/2005 Kuo ..... 401/195
7,147,224 B2 * 12/2006 Chuang ..... 273/153 S

* cited by examiner

*Primary Examiner*—Steven Wong
(74) *Attorney, Agent, or Firm*—Pai Patent & Trademark Law Firm; Chao-Chang David Pai

(57) ABSTRACT

A puzzle pen of which the penholder is formed of a shaft holding a writing member for writing, puzzle rings mounted on the shaft each holding a plurality of axially slidable puzzle blocks, and a retaining device, which has a locating ring with a receiving groove for receiving one puzzle block from the puzzle rings for enabling the user to rearrange the combination of the puzzle blocks, a cover shell rotatably mounted on the shaft to close/open the receiving groove of the locating ring, and a spring member supported between the locating ring and the cover shell to force the locating ring against the puzzle rings.

10 Claims, 5 Drawing Sheets

PUZZLE PEN

BACKGROUND OF THE INVENTION (a) Field of the Invention

The present invention relates to a pen and, more particularly, to a puzzle pen, which allows the user to play a picture puzzle.

(b) Description of the Prior Art

The penholder or barrel of a conventional writing implement, for example, a ballpoint pen, pencil, marker or color pen, has a fixed design, i.e., a user cannot change the outer design of the penholder or barrel of a writing implement. A writing implement of fixed outer design is monotonous.

U.S. Pat. No. 6,739,780, filed by the present inventor on Sep. 29, 2003, discloses a pen that has a plurality of ornamental rings that are rotatable individually to change the outer appearance of the penholder.

U.S. Pat. No. 6,966,717, filed by the present inventor on May 18, 2005, discloses a pen having a variable penholder. According to this design, a spring retainer is provided at one end of the penholder to hold ornamental rings against one another. When released from the spring retainer, the ornamental rings can be rotated to change the combination.

The aforesaid two prior art designs allow the user to rotate the ornamental rings individually so as to further change the outer appearance of the penholder. However, these two prior art designs do not allow the user to shift movable parts in longitudinal direction along the length of the penholder.

SUMMARY OF THE INVENTION

The present invention has been accomplished under the circumstances in view. According to one aspect of the present invention, the puzzle pen comprises a penholder formed of a shaft, a retaining device, and a plurality of puzzle rings. The shaft holds a writing member for writing. The puzzle rings are mounted on the shaft, each holding a plurality of axially slidable puzzle blocks. The retaining device comprises a locating ring with a receiving groove for receiving one puzzle block from the puzzle rings for enabling the user to rearrange the combination of the puzzle blocks, a cover shell rotatably mounted on the shaft to close/open the receiving groove of the locating ring, and a spring member supported between the locating ring and the cover shell to force the locating ring against the puzzle rings. According to another aspect of the present invention, the shaft has the top and bottom ends respectively mounted with a pen cap and a pen socket. According to another aspect of the present invention, the puzzle pen can be made in the form of a ballpoint pen, pencil, marker or color pen, or any of a variety of writing implement.

DETAILED DESCRIPTION OF THE PREFERRED EMBODIMENTS

Figure 1:
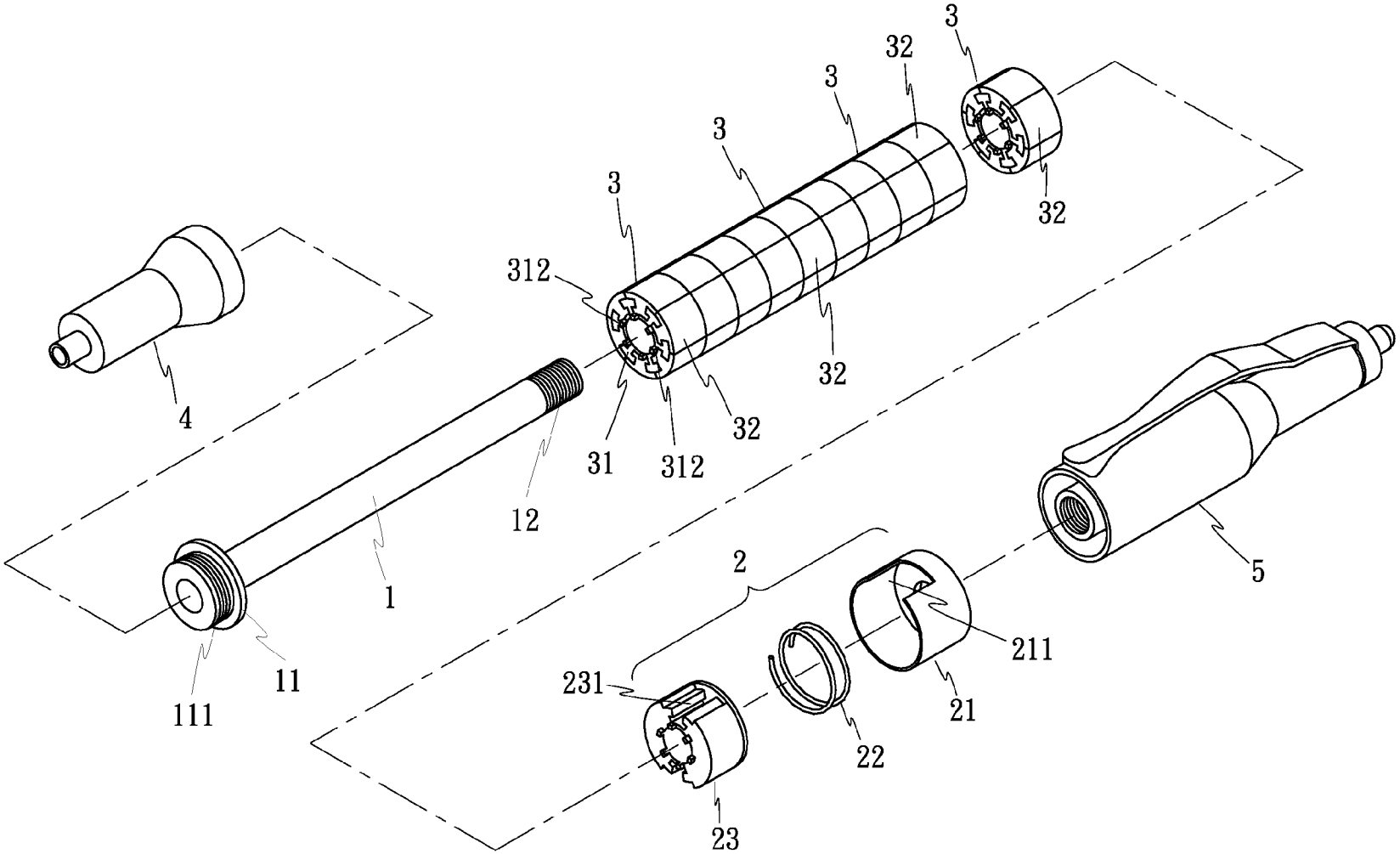
FIG. 1 is an exploded view of a puzzle pen according to the present invention.

Referring to FIGS. 1~5, a puzzle pen in accordance with the present invention is shown. It comprises a shaft 1, a retaining device 2, and a plurality of puzzle rings 3.

The shaft 1 is a hollow member inserted through the retaining device 2 and the puzzle rings 3, having a stop portion 11 at one end, namely, the bottom end, a first outer thread 111 extending around the periphery of the stop portion 11 for the mounting of a pen socket 4, and a second outer thread 12 extending around the periphery of the other end, namely, the top end for the mounting of a pen cap 5.

The retaining device 2 comprises a cover shell 21, a spring member 22, and a locating ring 23. The cover shell 21 is sleeved onto the shaft 1 and stopped against the pen cap 5 to hold the spring member 22 and the locating ring 23 on the inside, having a side opening 211. The locating ring 23 is sleeved onto the shaft 1 and stopped against the puzzle rings 3, having at least one receiving groove 231 formed on the periphery and extending through the top and bottom sides. The spring member 22 is mounted inside the cover shell 21 and stopped between an inside wall of the cover shell 21 and one side of the locating ring 23 to force the locating ring 23 against the puzzle rings 3 and to push the puzzle rings 3 toward the stop portion 11 of the shaft 1.

The puzzle rings 3 are sleeved onto the shaft 1 and stopped one against another between the stop portion 11 of the shaft 1 and the locating ring 23. As shown in FIGS. 6~9, each puzzle ring 3 comprises a body 31 and a plurality of puzzle blocks 32. The body 31 has a plurality of locating grooves 311 formed on the periphery and extending through the top and bottom sides for receiving the puzzle blocks 32, a plurality of coupling blocks 312 respectively protruded from the top side, and a plurality of coupling grooves 313 respectively formed on the bottom side. By means of coupling the coupling blocks 312 of the body 31 of one puzzle ring 3 to the coupling grooves 313 of the body 31 of another puzzle ring 3, the puzzle rings 3 are connected in a stack. The puzzle blocks 32 can be made in any of a variety of shapes and colors or marked with any of a variety of signs. When the respective coupling blocks 312 of a first puzzle ring 3 are disengaged from the corresponding coupling grooves 313 of a second puzzle ring 3, the two puzzle rings 3 can then be rotated relative to each other.

During the assembly process, the retaining device 2 and the puzzle rings 3 are sleeved onto the shaft 1, and then a writing member 6 (ink cartridge and writing tip assembly or the like) is axially inserted into the shaft 1, and then the pen socket 4 and the pen cap 5 are respectively threaded onto the first outer thread 111 and second outer thread 12 of the shaft 1.

According to the present preferred embodiment, the body 31 of each puzzle ring 3 has a plurality of coupling blocks 312 respectively protruded from the top side and a plurality of coupling grooves 313 respectively formed on the bottom side. Alternatively, the body 31 of each puzzle ring 3 can be made to have a plurality of coupling blocks 312 at the bottom side and a plurality of coupling grooves 313 at the top side. Further, according to the present preferred embodiment, the pen socket 4 and the pen cap 5 are respectively fastened to the two distal ends by means of a respective screw joint. Any of a variety of other connection structures and means may be used to substitute for the screw joint.

Figure 5:
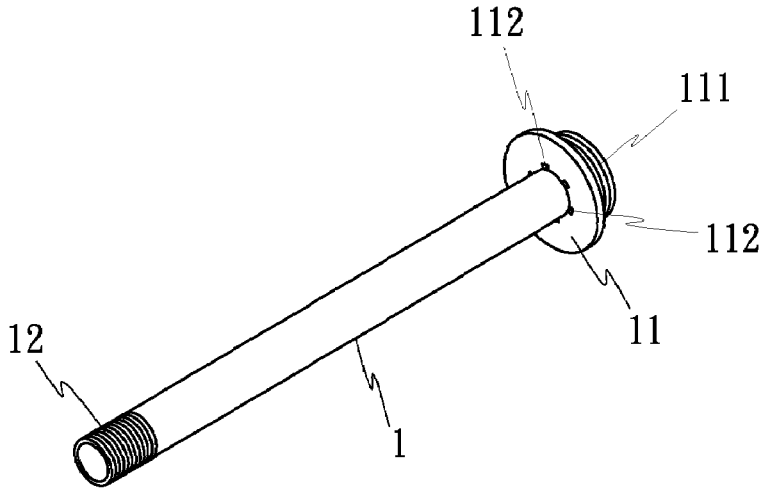
FIG. 5 is an elevational view of the shaft of the puzzle pen according to the present invention.
Figure 6:
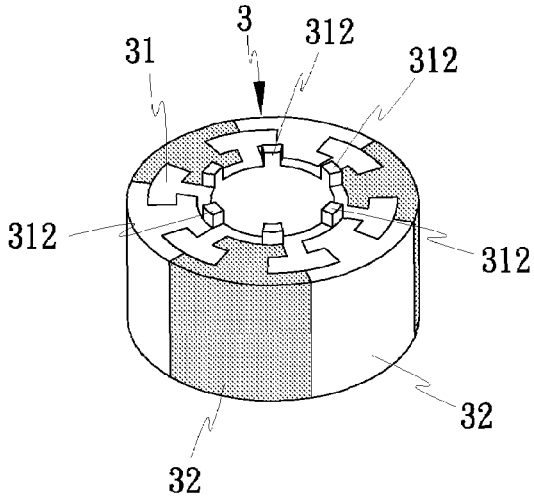
FIG. 6 is an oblique top elevation of one puzzle ring for the puzzle pen according to the present invention.
Figure 7:
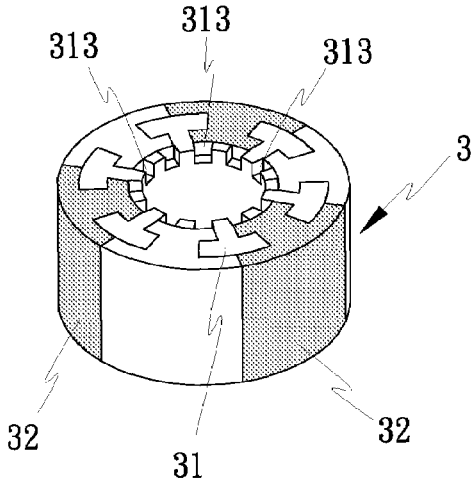
FIG. 7 is an oblique bottom elevation of one puzzle ring for the puzzle pen according to the present invention.
Figure 8:
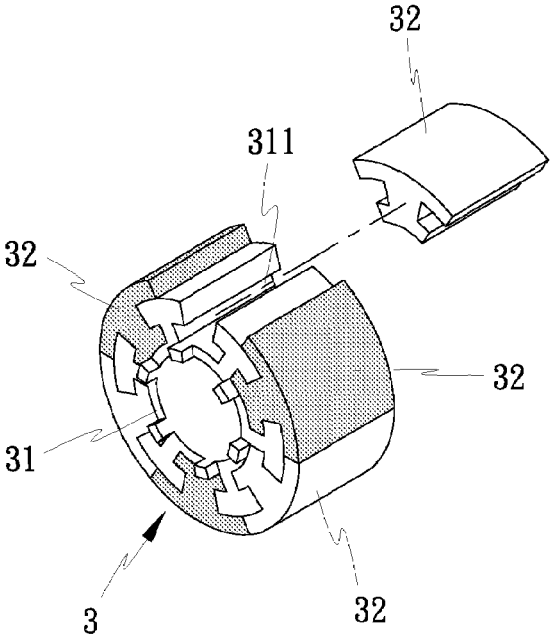
FIG. 8 is an exploded view of one puzzle ring for the puzzle pen according to the present invention.
Figure 9:
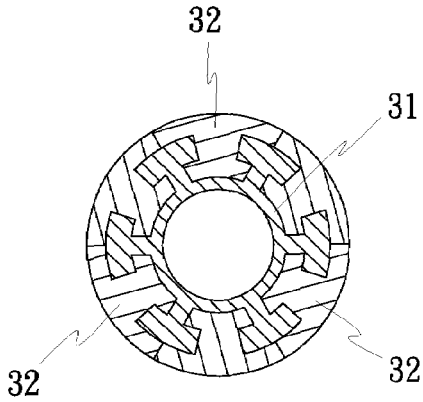
FIG. 9 is a cross sectional view of one puzzle ring for the puzzle pen according to the present invention.

As indicated above, the shaft 1 is a hollow member for accommodating the writing member 6. Further, as shown in FIG. 5, the shaft 1 can be made having a plurality of coupling grooves 112 at the top portion 11 for receiving the coupling blocks 312 of one of the puzzle rings 3. Alternatively, the shaft 1 can be made having a plurality of coupling blocks for engaging the coupling grooves 313 of one of the puzzle rings 3. Further, the puzzle pen can be made in the form of an automatic pen or non-automatic pen.

Figure 2:
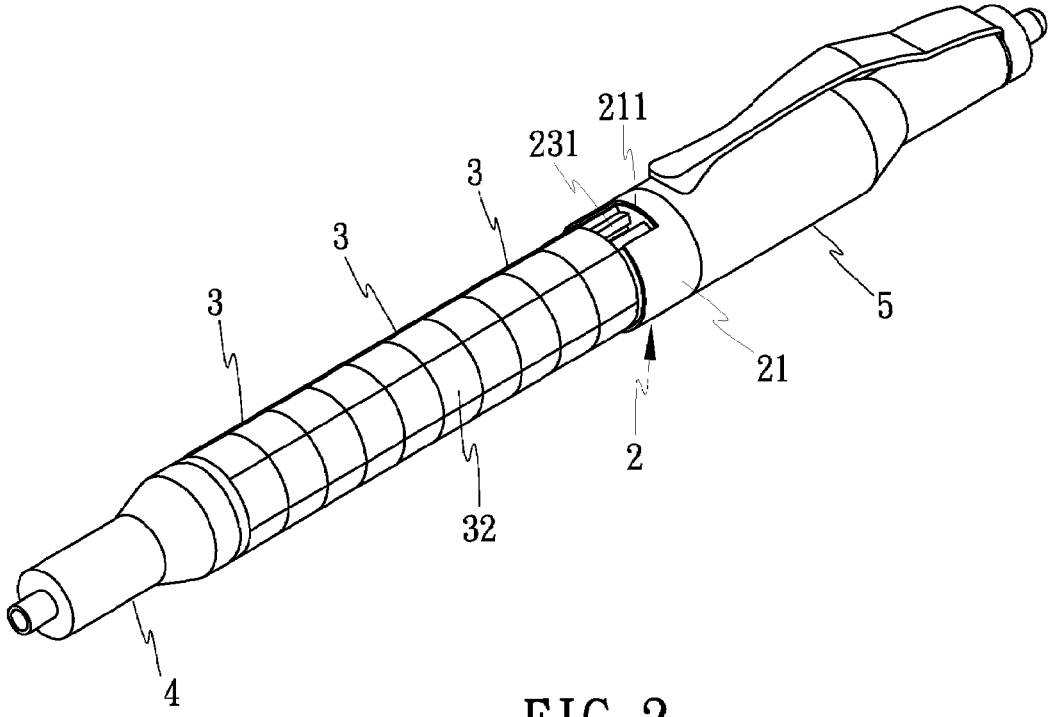
FIG. 2 is an elevational assembly view of the puzzle pen according to the present invention, showing the receiving groove of the locating ring being exposed to the outside.
Figure 3:
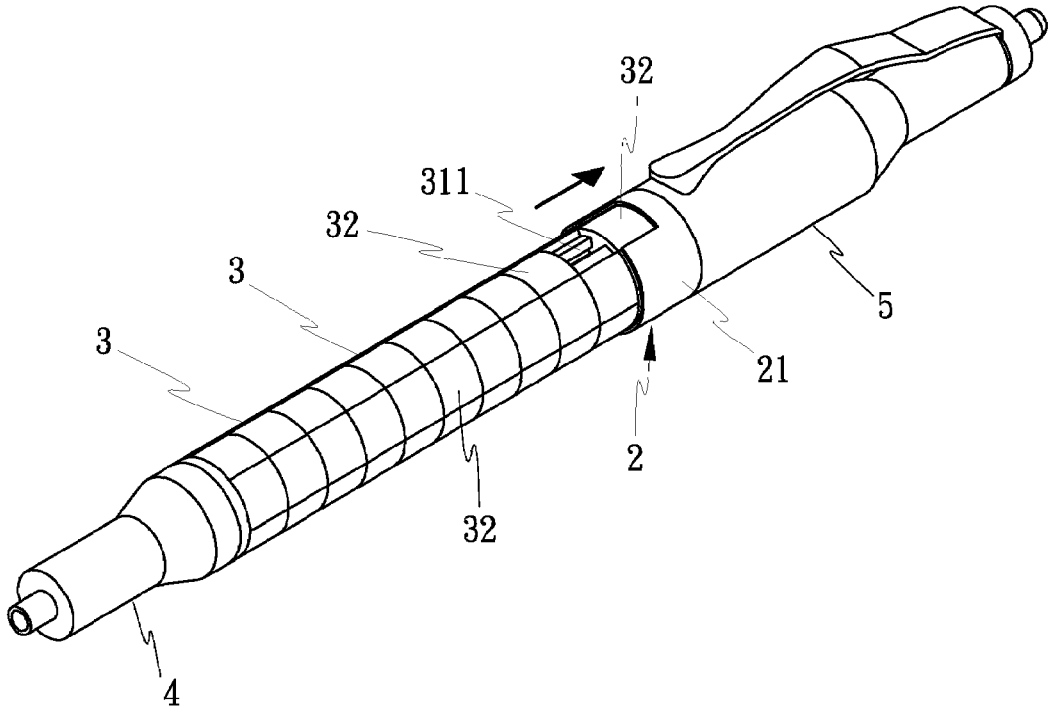
FIG. 3 corresponds to FIG. 2, showing one puzzle block shifted from one puzzle ring into the receiving groove of the locating ring.
Figure 4:
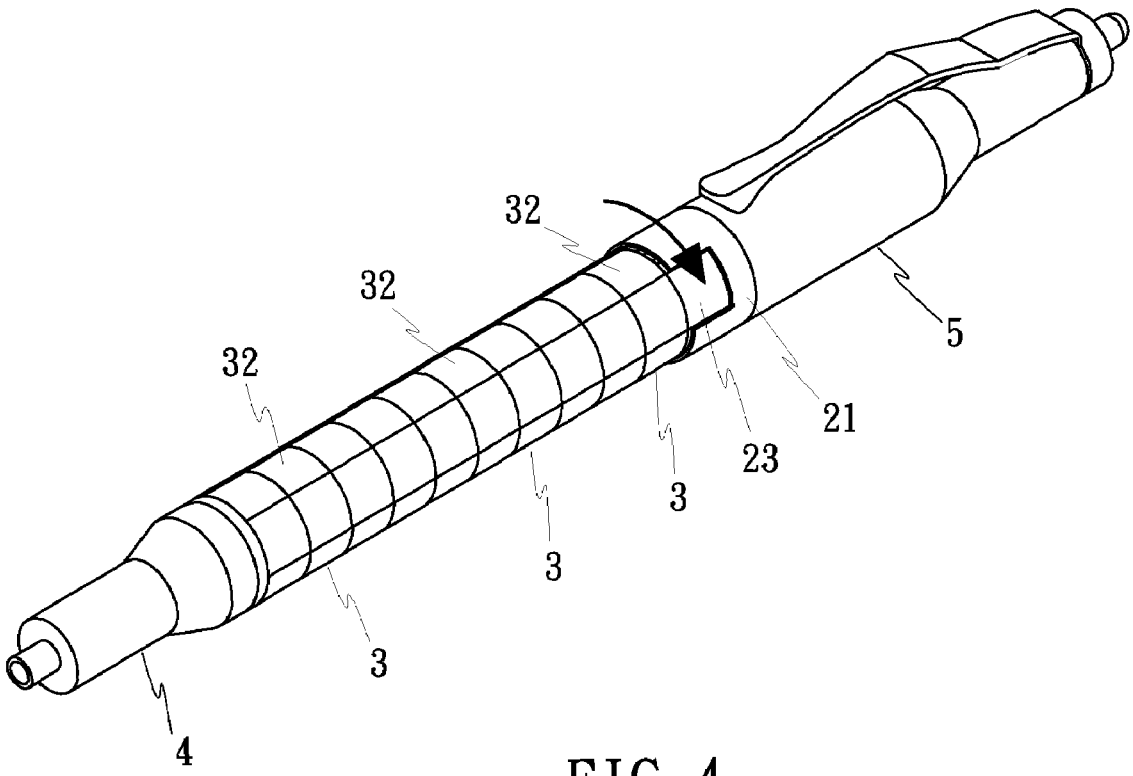
FIG. 4 is a schematic drawing of the present invention, showing the cover shell of the retaining device rotated through an angle to keep the receiving groove of the locating ring from sight.
Figure 10:
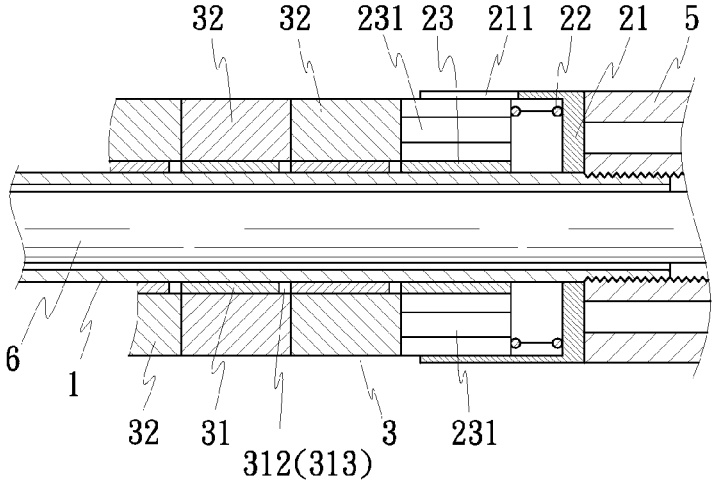
FIG. 10 is a longitudinal sectional view of a part of the present invention, showing the receiving groove of the locating ring being exposed to the outside.
Figure 11:
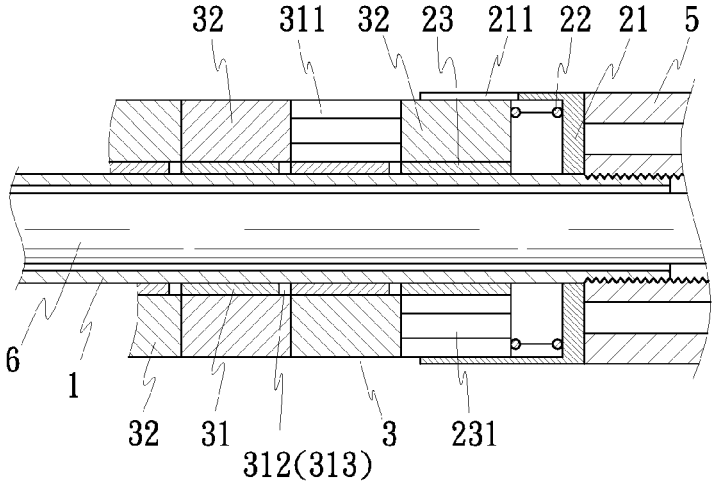
FIG. 11 is similar to FIG. 10 but showing one puzzle block shifted into the receiving groove of the locating ring.
Figure 12:
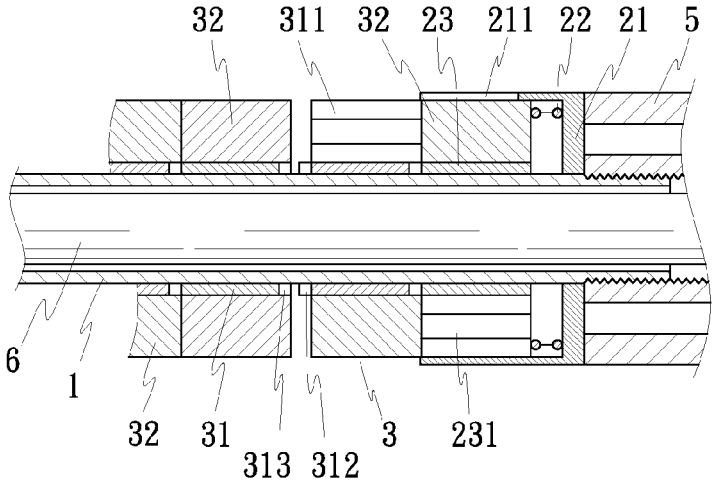
FIG. 12 is a longitudinal sectional view of the present invention, showing two puzzle rings separated.

When using the puzzle pen, rotate the cover shell 21 to have the side opening 211 in alignment with one receiving groove 231 of the locating ring 23 (see FIGS. 2 and 10). At this time, the respective receiving groove 231 is exposed to the outside, and the corresponding puzzle block 32 of the first puzzle ring 3 can be moved into the receiving groove 231 of the locating ring 23 (see FIGS. 3 and 11) to make the corresponding locating groove 311 available for receiving one puzzle block 32 of the second puzzle ring 3. By means of shifting one puzzle block 32 from one puzzle ring 3 to one locating groove 231 of another puzzle ring 3, the puzzle game is played. After the puzzle game is finished, the cover shell 31 is rotated through an angle to keep each receiving groove 231 of the locating ring 23 from sight, as in FIG. 4.

The main feature of the design of the present invention is to have the puzzle blocks 32 be respectively movable in longitudinal direction from one puzzle ring 3 to another and rotatable with the respective puzzle rings 3 in transverse direction so that the user can arrange the puzzle blocks 32 into one of a great number of combinations.

The retaining device 2 imparts a pressure to the puzzle rings 3 against the stop portion 11 of the shaft 1, keeping the puzzle rings 3 abutted against one another. When pushing one puzzle ring 3 in longitudinal direction toward the retaining device 2 against the pen cap 5, the retaining device 2 (the spring member 22) is compressed, and the respective puzzle ring 3 is disengaged from the next puzzle ring 3 for free rotation.

A prototype of puzzle pen has been constructed with the features of FIGS. 1~12. The puzzle pen functions smoothly to provide all of the features disclosed earlier.

Although a particular embodiment of the invention has been described in detail for purposes of illustration, various modifications and enhancements may be made without departing from the spirit and scope of the invention. For example, the puzzle pen can be made in the form of a ballpoint pen, pencil, marker, color pen, etc.; the shaft can be made having a stop portion at each of the two distal ends thereof for stopping the puzzle rings and the retaining device from falling out of the shaft. Accordingly, the invention is not to be limited except as by the appended claims.

What is claimed is:

1. A puzzle pen comprising a penholder holding a writing member for writing, said penholder comprising:

a shaft;

a plurality of puzzle rings respectively sleeved onto said shaft and abutted one against another, said puzzle rings each comprising a body, said body having a plurality of locating grooves spaced around the periphery thereof and extending through top and bottom sides thereof, and a plurality of puzzle blocks respectively coupled to said locating grooves; and a retaining device mounted on one end of said shaft to hold down said puzzle rings against one another, said retaining device comprising (a) a locating ring axially movably mounted on said shaft, said locating ring having at least one receiving groove respectively formed on the periphery thereof and extending through top and bottom sides thereof for receiving one puzzle block of said puzzle rings, (b) a cover shell rotatably mounted on said shaft and covering said locating ring to keep said at least one receiving groove of said locating ring from sight, said cover shell having a side opening for allowing one receiving groove of said locating ring to be exposed to the outside for receiving one puzzle block of said puzzle rings when said cover shell is rotated on said shaft relative to said locating ring through an angle to align said side opening with the receiving groove of said locating ring, and (c) a spring member mounted around said shaft and between said locating ring and said cover shell to force said locating ring against said puzzle rings.

2. The puzzle pen as claimed in claim 1, wherein said shaft has two stop portions respectively disposed at two distal ends thereof to stop said puzzle rings and said retaining device from falling out of said shaft.

3. The puzzle pen as claimed in claim 2, wherein said stop portions each have a plurality of coupling grooves respectively disposed at an inner side for the engagement of one puzzle ring and the cover shell of said retaining device respectively.

4. The puzzle pen as claimed in claim 1, wherein said shaft has a top end thereof mounted with a pen cap.

5. The puzzle pen as claimed in claim 1, wherein said shaft has a bottom end thereof mounted with a pen socket.

6. The puzzle pen as claimed in claim 1, wherein the body of each of said puzzle rings has a plurality of coupling blocks at a top side thereof and a plurality of coupling grooves at a bottom side thereof such that said puzzle rings are connectable to one another by engaging the coupling blocks of one puzzle ring into the coupling grooves of another puzzle ring.

7. The puzzle pen as claimed in claim 1, wherein said puzzle rings have an annular profile.

8. The puzzle pen as claimed in claim 1, wherein said puzzle blocks are respectively marked with a sign.

9. The puzzle pen as claimed in claim 1, wherein the body of each of said puzzle rings has a plurality of coupling blocks at a bottom side thereof and a plurality of coupling grooves at a top side thereof such that said puzzle rings are connectable to one another by engaging the coupling blocks of one puzzle ring into the coupling grooves of another puzzle ring.

10. The puzzle pen as claimed in claim 1, wherein said shaft is a hollow shaft adapted to accommodate said writing member for writing.

* * * * *